US006929395B1

(12) United States Patent
Metz

(10) Patent No.: US 6,929,395 B1
(45) Date of Patent: Aug. 16, 2005

(54) METHODS AND APPARATUS FOR RECLAIMING COMPONENTS OF CONCRETE AND OTHER SLURRIES

(76) Inventor: Jeffrey Lee Metz, 4000 Highway 78, Gratiot, WI (US) 53541

( * ) Notice: Subject to any disclaimer, the term of this patent is extended or adjusted under 35 U.S.C. 154(b) by 199 days.

(21) Appl. No.: 10/329,745

(22) Filed: Dec. 26, 2002

(51) Int. Cl.[7] ..... B01F 15/02
(52) U.S. Cl. ..... 366/366; 137/159.1
(58) Field of Search ..... 366/136, 137, 366/159.1; 210/765, 805, 194, 195.1, 197

(56) References Cited

U.S. PATENT DOCUMENTS

| | | | | |
|---|---|---|---|---|
| 989,915 A | | 4/1911 | Maguin | |
| 1,666,560 A | * | 4/1928 | Edeleanu et al. | 208/338 |
| 2,071,617 A | | 2/1937 | Daman | |
| 2,189,418 A | | 2/1940 | Finney | |
| 2,477,948 A | | 8/1949 | Allen | |
| 2,714,956 A | | 8/1955 | Marston | |
| 2,887,305 A | * | 5/1959 | Van Ginneken | 366/159.1 |
| 3,278,022 A | | 10/1966 | Moeschler | |
| 3,326,815 A | * | 6/1967 | Werner et al. | 516/79 |
| 3,596,759 A | | 8/1971 | King et al. | |
| 3,695,427 A | | 10/1972 | Friesz | |
| 3,997,434 A | * | 12/1976 | Macauley, Jr. | 209/10 |
| 4,016,978 A | | 4/1977 | Danna, Jr. | |
| 4,226,542 A | | 10/1980 | Black et al. | |
| 4,259,179 A | | 3/1981 | Marvin | |
| 4,340,472 A | | 7/1982 | Mixon | |
| 4,351,722 A | | 9/1982 | Mixon | |
| 4,548,507 A | | 10/1985 | Mathis et al. | |
| 5,127,740 A | * | 7/1992 | DeBoer | 366/2 |
| 5,149,192 A | | 9/1992 | Hamm et al. | |
| 5,268,111 A | * | 12/1993 | Metz et al. | 210/712 |
| 5,524,769 A | | 6/1996 | Spencer | |
| 5,695,280 A | | 12/1997 | Baker et al. | |
| 5,833,863 A | | 11/1998 | Richards et al. | |
| 6,758,590 B1 | * | 7/2004 | Black | 366/64 |

OTHER PUBLICATIONS

Enviro-Port Ready-Mix Reclamations Systems Brochure, Enviro-Port, Inc. (date unknown but presumed 2001).
Stephens Enviro-Matic Ready-Mix Reclaimers, Stephens Mfg. Co., Inc. (date unknown but presumed 2001).
Concrete Recycling Plant RA 20, Stetter GmBH (date unknown but presumed 2001).
The B+K 92 Series Ready Mixed Concrete Reclaiming Technology, BKS, Inc. (date unknown but presumed 2001).

* cited by examiner

*Primary Examiner*—David Sorkin
(74) *Attorney, Agent, or Firm*—Craig A. Fieschko, Esq.; DeWitt Ross & Stevens S.C.

(57) ABSTRACT

A reclamation system for the recycling of components of fluid concrete (such as concrete fines) and for concrete plant wastewater includes a slurry batch supply vessel which meters process water to a concrete batch mixing plant for use in concrete production processes, and a slurry retention vessel which collects stormwater, concrete truck washout, and other plant waste and wastewater for supply to the batch supply vessel when needed. The retention vessel, which may be no more than a waste pit, includes a fluid supply circuit which supplies water and suspended solids to the batch supply vessel, and a recirculation circuit which collects water and suspended solids from the retention vessel (or from the supply circuit) and reinjects the collected water and solids back into the retention vessel to agitate settled solids back into suspensions (so that they may be taken up by the supply circuit). As a result, the retention vessel will empty itself of accumulated water and waste solids and supply them (via the batch supply vessel) to the concrete batch mixing plant for recycling, rather than requiring the cost and inconvenient of periodic manual emptying.

20 Claims, 1 Drawing Sheet

THE FIGURE
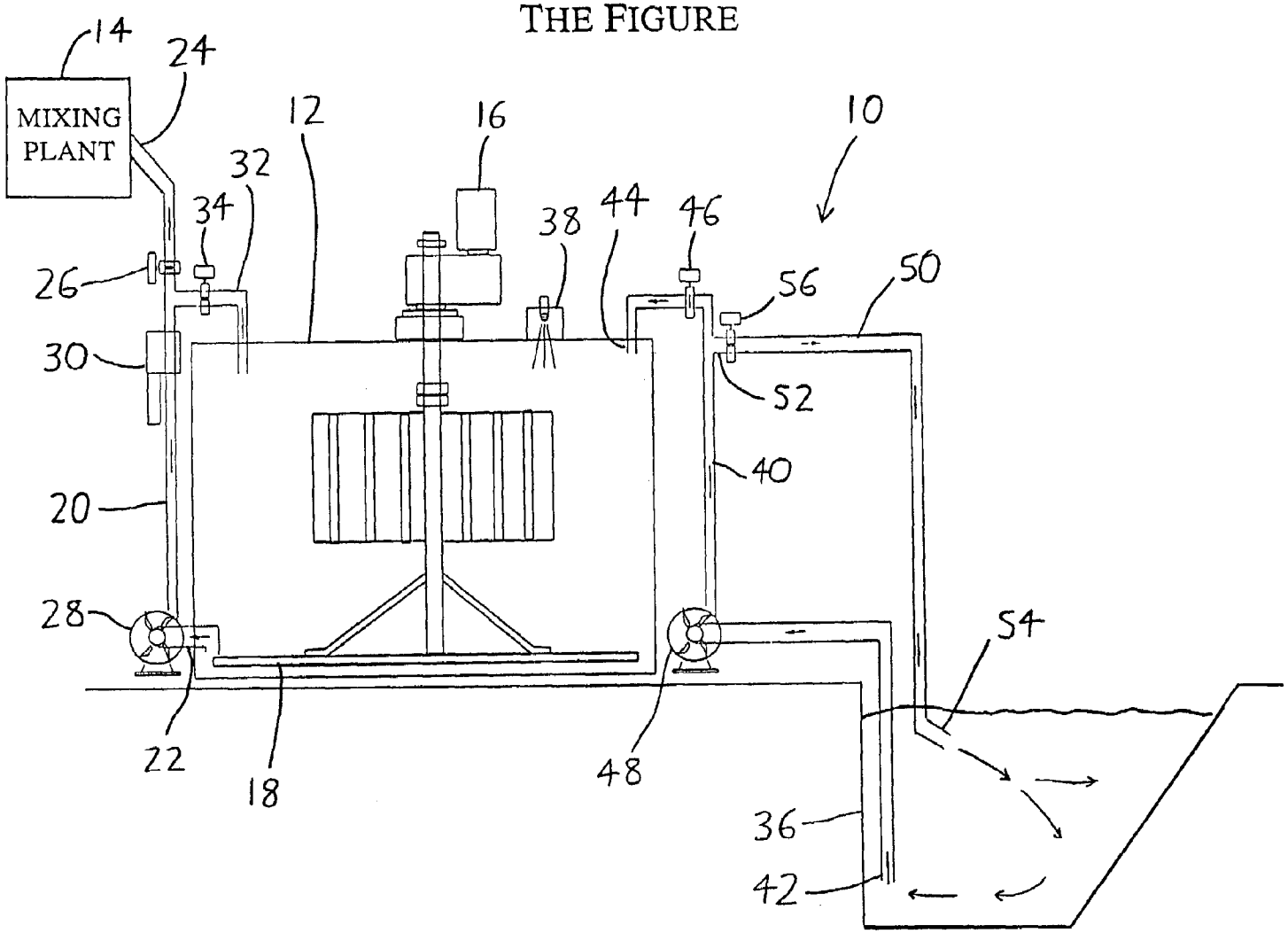

METHODS AND APPARATUS FOR RECLAIMING COMPONENTS OF CONCRETE AND OTHER SLURRIES

FIELD OF THE INVENTION

The disclosure concerns an invention relating generally to methods and apparatus for recycling components of slurries, in particular methods and apparata for separation, recovery, and/or reuse of components of fluid concrete (pourable, unset concrete).

BACKGROUND OF THE INVENTION

The popularity of concrete is continuously growing in the field of building materials, but so are environmental and economic pressures on concrete manufacturers, i.e., the producers of "ready-mix" concrete. Fluid (unset) concrete—including aggregate, sand, possibly industrial byproducts (such as fly ash), portland cement and water—is mixed in batchers at the concrete plant and hauled in concrete trucks to the construction site, where the fluid concrete mix is poured to set. Trucks often return to the plant and unused mix, leading to disposal issues. The mix cannot remain in the trucks for later use, or it will harden and render the trucks unusable. If the mix is merely dumped, it will generate long-term space issues since it will be difficult to remove later. Additionally, dumping generates environmental issues because stormwater and other runoff can wash out components of the mix and cause groundwater contamination. Dumping is also wasteful because high-quality concrete is expensive, and it would be preferable to reuse at least a portion of the mix.

Owing to the foregoing concerns, ready mix concrete plants often utilize recyclers, equipment which wash out unused mix and recover sand and aggregates for later use, and which supply the residual components to lined retention pits or other holding basins. The residues collected in the retention pits is often allowed to settle and set, with water being left to collect and evaporate. Because environmental regulations (e.g., the Clean Water Act in the United States) control runoff from the entire plant, the plant is often designed so that wastewater from the entirety of the plant site—such as stormwater, water from concrete truck washout, etc.—flows to the retention pits for collection. The retention pits thereby serve as the ultimate location for wastewater (and often other waste) generated directly or indirectly from the plants.

The use of such retention pits, while relatively simple and inexpensive, is space-intensive and leads to indirect costs from the loss of usable space. These indirect costs continue to grow as land grows scarcer. Additionally, the pits eventually grow unusable as the residue at their bottoms accumulates. Some of the residue sets to remain as a dense solid, which must eventually be broken out for removal (with subsequent disposal difficulties). Other portions remain as a highly toxic viscous sludge and slime which has high removal and disposal costs. The water in the retention pits can also generate problems if it accumulates since its high pH places legal prohibitions on its release. It would therefore be useful to have available methods and devices which alleviate or eliminate these disadvantages.

SUMMARY OF THE INVENTION

The invention involves a reclamation system which is intended to at least partially solve the aforementioned problems. To give the reader a basic understanding of some of the advantageous features of the invention, following is a brief summary of preferred versions of the reclamation system. As this is merely a summary, it should be understood that more details regarding the preferred versions may be found in the Detailed Description set forth elsewhere in this document. The claims at the end of this document then define the various versions of the invention in which exclusive rights are secured.

The reclamation system includes a slurry retention vessel wherein runoff and/or other waste liquid and solids are collected (these materials hereinafter being referred to as "process water"), and a slurry batch supply vessel which receives process water from the retention vessel and holds it for later supply to a concrete batch mixing plant (a plant where ready mix concrete is prepared). The batch supply vessel preferably includes an agitator therein to mix the process water and deter any solids therein from setting into a solid mass. The retention vessel, being a collection point for process water for later supply to the concrete batch mixing plant (via the batch supply vessel), may simply be provided in the form of an open-topped water collection pit which is sunken below grade to collect plant runoff. The batch supply vessel, on the other hand, preferably allows a plant operator greater control over its contents (e.g., it allows some control over the relative solids-to-water content of the process water), and is therefore preferably provided as a vessel which is at least partially enclosed so that the unwanted or uncontrolled entry of water is deterred.

A fluid supply circuit provides the process water from the retention vessel to the batch supply vessel. The supply circuit preferably includes a supply line inlet opening onto the slurry retention vessel, a downstream supply line outlet opening onto the slurry batch supply vessel, and an intermediate supply valve which can terminate flow of process water through the supply circuit. A supply pump can also be provided on the supply line, preferably upstream from the supply pump, if some type of motive force is needed to supply process water through the supply line (e.g., if the process water does not flow via gravity, or otherwise flow without assistance).

A fluid recirculation circuit is also provided wherein water is taken from and returned to the retention vessel, thereby stirring the process water therein and helping to resuspend sunken solids in the retention vessel prior to uptake of its process water by the supply circuit. While the recirculation circuit can be entirely separate of the supply circuit, it preferably includes a portion of the supply line (most preferably a portion located upstream from the supply line outlet and supply valve), and also includes a recirculation line extending from a recirculation line inlet on the supply line to a recirculation line outlet at the slurry retention vessel. Thus, if process water flows into the supply line inlet from the retention vessel, and if the supply valve is closed, the process water will flow from the supply line into the recirculation line and back into the retention vessel, agitating any solids therein. The recirculation line also preferably includes a recirculation valve therein so that flow within the recirculation circuit may be halted when desired.

As a result of the foregoing arrangement, the supply valve and recirculation valve may be used to selectively divert process water between the supply circuit and the recirculation circuit. The system can be switched to a stirring state wherein the supply valve is closed and the recirculation valve is open, whereby process water within the retention vessel is circulated through the recirculation circuit to at least partially mix the contents of the retention vessel. The system can subsequently be switched to a charging state wherein the supply valve is open and the recirculation valve is closed, whereby the mixed process water within the retention vessel is provided through the supply line to recharge the slurry batch supply vessel.

In similar fashion, any plant line supplying process water from the batch supply vessel to the concrete batch mixing plant may include a recycling line extending therefrom and returning back to the batch supply vessel, whereby any contents of the batch supply vessel traveling through the plant line may be at least partially returned to the batch supply vessel to maintain flow in the plant line and prevent fouling from settling and setting solids. While this arrangement could serve to agitate the contents of the batch supply vessel instead (or in addition to) any agitator provided therein, it need not serve to significantly mix the contents of the batch supply vessel, and may instead serve to merely prevent settling and setting within the plant line.

Further advantages, features, and objects of the invention will be apparent from the following detailed description of the invention in conjunction with the associated drawings.

BRIEF DESCRIPTION OF THE DRAWINGS

The FIGURE is a schematic diagramic of a preferred version of the invention.

DETAILED DESCRIPTION OF PREFERRED EMBODIMENTS OF THE INVENTION

An exemplary version of the invention will now be described with reference to the accompanying FIGURE, wherein a reclamation system is generally designated by the reference numeral 10. A slurry batch supply vessel, depicted at the reference numeral 12, is intended to provide process water on an as-needed basis to a concrete branch mixing plant (depicted schematically at 22) for use in preparing new batches of ready-mix concrete. The batch supply vessel 12 may be provided by the pin present in a common ready-mix aggregate reclamation system, that is, the batch supply vessel 12 can be the bin used to contain residue recovered after fluid concrete (unset concrete) has undergone processes to remove solids ranging from aggregate size down to approximately sand size. Thus, the batch supply vessel 12 will generally contain water and concrete components obtained after removal of particulates (aggregates, cobbles, etc.) down to approximately the sieve size of sand.

In practice, the batch supply vessel 12 may contain ingress and egress points for input and removal of fresh and/or process water, and concrete and/or concrete components. For example, the batch supply vessel 12 may be provided with one or more infeed hoppers at its top or side for allowing input of unused/surplus fluid concrete (as by pouring it directly from a ready-mix truck). Alternately or additionally, the batch supply vessel 12 may include screw conveyors or other solids removal devices at its bottom or side for removal of aggregate, sand, and/or other particulates. However, these features are not illustrated in the FIGURE. As will be discussed below, apart from any process water provided to the batch supply vessel 12 during aggregate reclamation, process water is also preferably provided from a slurry retaining vessel 36, which is used to collect wastewater, waste fluid concrete mix, and/or components thereof.

Since the process water within the batch supply vessel 12 may contain components of fluid concrete (i.e., concrete which has not yet set), whether from concrete truck washout, dumping of unused mix, rainwater washoff, or other sources, the batch supply vessel 12 preferably includes an agitator of some sort to keep the process water in motion so settled solids do not gel into a solid (and difficult to remove) mass. Here, the agitator is depicted as an agitator drive 16 driving an impeller 18 within the batch supply vessel 12 to stir its contents and prevent them from setting.

The concrete batch mixing plant 14 is supplied with process water from the supply vessel 12 via a plant line 20. The plant line 20 has a plant line inlet 22 opening onto the batch supply vessel 12, a plant line outlet 24 leading to the branch mixing plant 14, and preferably also a plant line valve 26 situated therebetween. Unless gravity or other means is used to supply the process water from the batch supply vessel 12 to the mixing plant 14, a plant line pump 28 may be provided to drive the process water from the supply vessel 12 through the plant line 20 (provided the plant line valve 26 is open). Since the components of the batch supply vessel 12 may (and generally will) contain suspended solids, and since some standards (e.g., ASTM-C94) may limit the amount of solids which should be present in a newly-produced ready-mix batch at the mixing plant 14, a density meter 30 may be included on the plant line 20 to monitor the specific gravity of the process water therein and thereby determine its solids content. If the solids content exceeds mandated amounts, the process water might be diluted by addition of fresh water to the batch supply vessel 12.

Once the requisite amount of process water is received by the mixing plant 14 from the batch supply vessel 12, the plant line pump 28 may be deactivated, thereby ceasing flow through the plant line 20. Any process water situated in the plant line 20 between the batch supply vessel 12 and the mixing plant 14 may be allowed to drain back into the batch supply vessel 12, preferably via a recycling line 32 which branches off of the plant line 20 and which has a normally closed (but now open) recycling valve 34. In the meantime, note that when the system 10 is provided in the configuration illustrated in the FIGURE, many of the solids in the process water will fall down the plant line 20 towards the plant line pump 28 as they settle. At some time thereafter, the plant line valve 26 may be closed (with the recycling valve 34 left open), and the plant line pump 28 may be periodically actuated (or continuously actuated, if desired) to prevent any solids within the batch supply vessel 12 from seizing the plant line pump 28. In general, it has been found that it is only necessary to operate the plant line pump 28 in this manner for a period of 30 seconds to a few minutes every half-hour or so in order to prevent solids from seizing the plant line pump 28. However, more periodic actuation and/or longer actuation times may be necessary if the solids content within the batch supply vessel 12 (and thus the plant line 20) is high.

Of course, in order for the batch supply vessel 12 to dependably provide process water to the mixing plant 14, it must itself have some form of process water supply. Such a water input into the batch supply vessel 12 may be provided by fresh water infeed from a municipal or other water supply (such an infeed not being shown in the FIGURE), or by water supplied from previously performed reclamation processes. However, to best reach economy and waste reduction goals, the preferred water supply for the batch supply vessel 12 is from a slurry vessel 36, such as those commonly used in ready-mix plants for collection of runoff and/or wastewater, unwanted fluid concrete mix, and components thereof (such as that collected after concrete truck washout, or from dumping of unwanted fluid concrete within the retention vessel 36). When the process water level within the batch supply vessel 12 drops below some predetermined depth (as determined by a level sensor 38, such as an ultrasonic level sensor), water in the retaining vessel 36 is supplied to the batch supply vessel 12 through a supply line 40. The supply line 40 has a supply line inlet 42 opening onto the retaining vessel 36, and it opens onto the batch supply vessel 12 at a supply line outlet 44 at its opposite end. A supply valve 46 is also provided between the supply line inlet 42 and the supply line outlet 44 to terminate flow in the supply line 40 when desired. If gravity or other means do not cause process water to automatically flow in the supply line 40 from the supply line inlet 42 to the supply line outlet 44, a supply pump 48 may be provided in the supply line 40, preferably at a location slightly upstream from the supply line outlet 44, to provide motive force for the process water therein. Once the level sensor 38 detects the desired level of water is present within the batch supply vessel 12, the supply pump 48 may be deactivated.

However, before supplying process water from the retaining vessel 36 to the batch supply vessel 12 via the supply line 36, it is useful to have the system 10 agitate the process water within the retaining vessel 36 to place any sunken solids in suspension, with the resuspended solids then being taken in through the supply line 40 to be provided to the supply vessel 12. This helps avoid accumulation of solids within the retaining vessel 36, thereby avoiding the need to later break out and dispose of the solids and instead supplying them to the batch supply vessel 12 for disposal as concrete filter. The following components and steps help achieve this purpose. A recirculation line 50 branches off of the supply line 40 at a recirculation line inlet 52 upstream from the supply valve 46 (and downstream from the supply pump 48), with the recirculation line 50 having a recirculation line outlet 54 within the retaining vessel 36 and a recirculation valve 56 between the inlet 52 and outlet 54. Before opening the supply valve 46 to supply water to the batch supply vessel 12, the supply pump 48 is first activated with the recirculation valve 56 open (and with the supply valve 46 closed). Water from the retaining vessel 36 is therefore taken in, pressurized, and sent back into the retaining vessel 36 at high velocity. The recirculation line 50 will therefore stir up the solids in the retaining vessel 36, particularly if the recirculation line outlet 54 is directed towards the bottom of the retaining vessel 36. This stirring preferably continues for a predetermined period of time, perhaps 30 seconds to 5 minutes, to mix the water within the retaining vessel 36. Once the mixing period is completed, the supply valve 46 may be opened, the recirculation valve 56 may be closed, and water may be pumped through the supply line 40 to the batch supply vessel 12 until the level sensor 38 determines that the desired water level has been reached within the batch supply vessel 12. As a result, the sludge and solids within the retaining vessel 36 may be at least partially removed from the retaining vessel 36 and recycled by sending them into the batch supply vessel 12, and subsequently to the mixing plant 14 for rebatching. This results in little or no buildup of solid/sludge within the retaining vessel 36, and thereby at least reduces later cleanup problems. Additionally, the retaining vessel 36 may be made much smaller than usual because the frequent withdrawal and reuse of its water for recharging of the batch supply vessel 12 helps to prevent the retaining vessel 36 from overflowing.

The effectiveness of the recirculation circuit in removing accumulated solids and sludge within the retaining vessel 36 will depend on such factors as the water and solids level within the retaining vessel 36; the orientation and pressure of the recirculation line outlet 54; the relative configuration of the recirculation line outlet 54 and retaining vessel 36; and so forth. If desired, the retaining vessel 36, supply line inlet 42, and recirculation line outlet 54 can be specially arranged and configured to enhance resuspension of solids/sludge within process water in the retaining vessel 36. As an example, the retaining vessel 36 might be in the form of a circular tank or sunken pit wherein the recirculation line outlet 54 is at or near the tank/pit's outer perimeter, and is oriented at an angle which is generally tangential to the circumference of the retaining vessel 36. The supply line inlet 42 may then be situated at the center of the retaining vessel 36. In this configuration, the recirculation line 50 should help swirl water in vortex-like fashion about the retaining vessel 36 so that solids will be swept towards the center of the retaining vessel 36 and to the supply line inlet 42. Alternatively, multiple recirculation line outlets 54 may be provided which branch off of the recirculation line 50 in various directions, and these various outlets 54 may be directed towards various portions of the retaining vessel 36 to flush accumulated sludge/solids therefrom. As another example, the recirculation line outlet(s) 54 might be made to reciprocate or otherwise move with respect to the remainder of the recirculation line 50 so that the jet(s) of water coming from the outlet(s) 54 will wash over different areas of the retaining vessel 36 at different times, dislodging any solids therefrom. Potential configurations for such an arrangement can be drawn from the field of reciprocating/moving water sprinklers, wherein the water pressure within a sprinkler supply hose is used to provide the motive force for reciprocating or otherwise moving one or more spray nozzles. A similar arrangement could be used for the recirculation line outlet 54 so that it sweeps about the retaining vessel 36.

As a result of the foregoing arrangement, produces of ready-mix concrete may recycle some or all of their waste water and/or waste solids collected within their retention vessels 36, with the water being reused and the waste solids being recycled as filler for new concrete (thereby avoiding later disposal problems).

It is understood that the various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

First, note that where fluid-carrying lines are described as extending from one component to another—for example, the supply line is stated to extend between the slurry retention vessel and the slurry batch supply vessel—it should be understood that such lines may be formed of conduits other than pipes, and that they may be formed of more that one component. Stated differently, each or any of the supply line, recirculation line, plant line, etc. need not take the form of a single continuous pipe or other conduit, and may instead take the form of multiple pipes or other fluid-carrying conduits, in series and/or in parallel, and connected by one or multiple other components.

Second, the batch supply vessel may be provided with means to drain off excess water should it become overfilled. As an example, a valved drain pipe or other conduit may drain excess process water back to the retaining vessel 36 for later reuse.

The invention is not intended to be limited to the preferred versions of the invention described above, but rather is intended to be limited only by the claim set out below. Thus, the invention encompasses all different versions that fall literally or equivalently within the scope of these claims.

What is claimed is:

1. A reclamation system for concrete slurry components comprising:

a. a slurry retention vessel;

b. a slurry batch supply vessel including an agitator therein;

c. a supply circuit wherein water is provided from the slurry retention vessel to the slurry batch supply vessel;

d. a recirculation circuit including an inlet and an outlet, wherein water is provided from the slurry retention vessel at the inlet and returned to the slurry retention vessel at the outlet, and wherein the outlet extends into the retention vessel and is directed to eject water at a non-perpendicular angle with respect to the bottom of the slurry retention vessel;

e. a concrete batch mixing plant; and f. a plant line leading from the slurry batch supply vessel to the concrete batch mixing plant, wherein the flow of water is selectively divertable between the supply circuit and recirculation circuit, thereby allowing:

(1) flow of water through the recirculation circuit to at least partially mix any contents of the slurry retention vessel, and (2) subsequent flow of water and mixed slurry retention vessel contents through the supply circuit from the slurry retention vessel to the slurry batch supply vessel.

2. The reclamation system of claim 1 wherein the plant line includes a recycling line extending therefrom to reenter the slurry batch supply vessel, whereby any contents of the slurry batch supply vessel traveling through the plant line may be at least partially returned to the slurry batch supply vessel.

3. A reclamation system for concrete slurry components comprising:

a. slurry retention vessel having an open top;

b. a slurry batch supply vessel including an agitator therein;

c. a supply circuit wherein water is provided from the slurry retention vessel to the slurry batch supply vessel;

d. a recirculation circuit including an inlet and an outlet, wherein water is provided from the slurry retention vessel at the inlet and returned to the slurry retention vessel at the outlet, and wherein the outlet extends into the retention vessel and is directed to eject water at a non-perpendicular angle with respect to the bottom of the slurry retention vessel;

wherein the flow of water is selectively divertable between the supply circuit and recirculation circuit, thereby allowing:

(1) flow of water through the recirculation circuit to at least partially mix any contents of the slurry retention vessel, and (2) subsequent flow of water and mixed slurry retention vessel contents through the supply circuit from the slurry retention vessel to the slurry batch supply vessel, and wherein the slurry retention vessel has no conduits withdrawing water therefrom, save for any conduits included in the supply circuit and recirculation circuit.

4. The reclamation system of claim 3 wherein the batch supply vessel is fully enclosed.

5. A reclamation system for concrete slurry components comprising:

a. a slurry retention vessel including a sunken pit having an open top;

b. a slurry supply vessel including the agitator therein;

c. a supply circuit wherein water is provided from the slurry retention vessel to the slurry batch supply vessel;

d. a recirculation circuit including an inlet and an outlet, wherein water is provided from the slurry retention vessel at the inlet and returned to the slurry retention vessel at the outlet, and wherein the outlet extends into the retention vessel and is directed to eject water at a non-perpendicular angle with respect to the bottom of the slurry retention vessel;

wherein the flow of water is selectively divertable between the supply circuit and recirculation circuit, thereby allowing:

(1) flow of water through the recirculation circuit to at least partially mix any contents of the slurry retention vessel, and (2) subsequent flow of water and mixed slurry retention vessel contents through the supply circuit from the slurry retention vessel to the slurry batch supply vessel.

6. The reclamation system of claim 5 wherein the batch supply vessel is fully enclosed.

7. A reclamation system for concrete slurry components comprising:

a. a slurry retention vessel;

b. a slurry batch supply vessel including an agitator therein;

c. a supply circuit including a supply line having:

i. a supply line inlet at the slurry retention vessel, and ii. a downstream supply line outlet at the slurry batch supply vessel;

wherein water is provided from the slurry retention vessel to the slurry batch supply vessel;

d. a recirculation circuit including i. a portion of the supply line upstream from the supply line outlet, and ii. a recirculation line including:

(1) an inlet wherein water is provided from the slurry retention vessel, (2) an outlet through which water is returned to the slurry retention vessel, and wherein the outlet extends into the slurry retention vessel and is directed to eject water at a non-perpendicular angle with respect to the bottom of the slurry retention vessel, and (3) a recirculation valve therein;

wherein the flow of water is selectively divertable between the supply circuit and recirculation circuit, thereby allowing:

(1) flow of water through the recirculation circuit to at least partially mix any contents of the slurry retention vessel, and (2) subsequent flow of water and mixed slurry retention vessel contents through the supply circuit from the slurry retention vessel to the slurry batch supply vessel.

8. The reclamation system of claim 7 further comprising a supply valve situated between the supply line inlet and the supply line outlet, wherein:

a. the recirculation circuit includes a portion of the supply line upstream from the supply valve;

b. the recirculation valve may be opened to provide water through the recirculation circuit, and c. the supply valve may be opened to provide water and mixed slurry retention vessel contents through the supply circuit.

9. A reclamation system for concrete slurry components comprising:

a. a slurry retention vessel;

b. a slurry batch supply vessel including an agitator therein;

c. a supply circuit including a supply line having:
i. a supply line inlet at the slurry retention vessel,
ii. a downstream supply line outlet at the slurry batch supply vessel, and
iii. a supply valve therebetween;
wherein water is provided from the slurry retention vessel to the slurry batch supply vessel;
d. a recirculation circuit including:
i. a portion of the supply line upstream from the supply valve, and
ii. a recirculation line including:
(1) an inlet wherein water is provided from the slurry retention vessel,
(2) an outlet through which water is returned to the slurry retention vessel, wherein the outlet extends into the retention vessel and is directed to eject water at a non-perpendicular angle with respect to the bottom of the slurry retention vessel, and
(3) a recirculation valve therein,
wherein the recirculation valve may be opened to provide water through the recirculation circuit, and the supply valve may be opened to provide water and mixed slurry retention vessel contents through the supply circuit, and
wherein the flow of water if selectively divertable between the supply circuit and recirculation circuit, thereby allowing:
(1) flow of water through the recirculation circuit to at least partially mix any contents of the slurry retention vessel, and
(2) subsequent flow of water and mixed slurry retention vessel contents through the supply circuit from the slurry retention vessel to the slurry batch supply vessel.

10. A reclamation system for slurry components of a concrete batch mixing plant, the reclamation system comprising:
a. a slurry retention vessel, the slurry retention vessel being defined by a sunken pit;
b. a slurry batch supply vessel including an agitator therein;
c. a recirculation circuit wherein water is provided from and returned to the slurry retention vessel;
d. a supply line outlet extending from the recirculation circuit, through which water provided from the recirculation circuit may be diverted to the slurry batch supply vessel;
e. a plant line leading from the slurry batch supply vessel to the concrete batch mixing plant.

11. The reclamation system of claim 10 wherein:
a. the recirculation circuit includes:
i. a portion of a supply line, the supply line extending from a supply line inlet at the slurry retention vessel to the supply line outlet;
ii. a recirculation line extending from the supply line to the slurry retention vessel;
b. the recirculation circuit further comprises a recirculation valve therein, and
c. closure of the recirculation valve effects the flow of water through the supply line outlet.

12. The reclamation system of claim 11 wherein the supply line includes a supply valve downstream from the recirculation circuit.

13. The reclamation system of claim 12 wherein closure of the supply valve effects the flow of water through the recirculation circuit.

14. The reclamation system of claim 11 wherein:
a. the slurry retention vessel has an open top, and
b. the slurry batch supply vessel is at least substantially closed.

15. The reclamation system of claim 14 wherein the slurry retention vessel is situated below grade.

16. The reclamation system of claim 10 wherein recirculation circuit includes an inlet and an outlet, wherein:
a. water is provided from the slurry retention vessel at the inlet and returned to the slurry retention vessel at the outlet, and
b. the outlet extends into the retention vessel and is directed to eject water at a non-perpendicular angle with respect to the bottom of the slurry retention vessel.

17. A reclamation system for slurry components comprising:
a. a slurry retention vessel;
b. a slurry batch vessel including an agitator therein;
c. a supply line including:
i. a supply line inlet opening onto the slurry retention vessel;
ii. a supply pump downstream from the supply line inlet;
iii. a supply valve downstream from the supply pump; and
iv. a supply line outlet opening onto the slurry batch supply vessel;
d. a recirculation line including:
i. a recirculation line inlet on the supply line upstream from the supply valve;
ii. a recirculation valve downstream from the recirculation line inlet; and
iii. a recirculation line outlet opening onto the slurry retention vessel;
e. a concrete batch mixing plant; and
f. a plant line leading from the slurry batch supply vessel to the concrete batch mixing plant,
wherein the system includes the following states:
(1) a stirring state wherein the supply pump is active with the supply valve closed and the recirculation valve is open, whereby fluid within the slurry retention vessel is circulated through the supply line and recirculation line;
(2) a charging state wherein the supply pump is active with the supply valve open and the recirculation valve is closed, whereby fluid within the slurry retention vessel is provided through the supply line to the slurry batch supply vessel.

18. A reclamation system for slurry components comprising:
a. a slurry retention vessel including an open-topped pit;
b. a slurry batch supply vessel including an agitator therein;
c. a supply line including:
i. a supply line inlet opening onto the slurry retention vessel;
ii. a supply pump downstream from the supply line inlet;
iii. a supply valve downstream from the supply pump; and
iv. a supply line outlet opening onto the slurry batch supply vessel;
d. a recirculation line including:
i. a recirculation line inlet on the supply line upstream from the supply valve;
ii. a recirculation valve downstream from the recirculation line inlet; and
iii. a recirculation line outlet opening onto the slurry retention vessel;

wherein the system includes the following states;

(1) a stirring state wherein the supply pump is active with the supply valve closed and the recirculation valve is open, whereby fluid within the slurry retention vessel is circulated through the supply line and recirculation line;

(2) a charging state wherein the supply pump is active with the supply valve open and the recirculation valve is closed, whereby fluid within the slurry retention vessel is provided through the supply line to the slurry batch supply vessel.

19. The reclamation system of claim 18 wherein the batch supply vessel is fully enclosed.

20. A reclamation system for slurry components comprising:

a. a slurry retention vessel;

b. a slurry batch vessel including an agitator therein;

c. a supply line including:

i. a supply line inlet opening onto the slurry retention vessel;

ii. a supply pump downstream from the supply line inlet;

iii. a supply valve downstream from the supply pump; and iv. a supply line outlet opening onto the slurry batch supply vessel;

d. a recirculation line including:

i. a recirculation line inlet on the supply line upstream from the supply valve;

ii. a recirculation valve downstream from the recirculation line inlet; and iii. a recirculation line outlet opening onto the slurry retention vessel, wherein the recirculation line outlet extends into the retention vessel and is directed to eject water at a non-perpendicular angle with respect to the bottom of the slurry retention vessel;

wherein the system includes the following states;

(1) a stirring state wherein the supply pump is active with the supply valve closed and the recirculation valve is open, whereby fluid within the slurry retention vessel is circulated through the supply line and recirculation line;

(2) a charging state wherein the supply pump is active with the supply valve open and the recirculation valve is closed, whereby fluid within the slurry retention vessel is provided through the supply line to the slurry batch supply vessel.

* * * * *